US009777976B2

(12) United States Patent
Moskovitch

(10) Patent No.: US 9,777,976 B2
(45) Date of Patent: Oct. 3, 2017

(54) SPENT CARTRIDGES ROUTER

(71) Applicant: RAFAEL ADVANCED DEFENSE SYSTEMS LTD., Haifa (IL)

(72) Inventor: Omer Moskovitch, Bha'chan (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 195 days.

(21) Appl. No.: 14/210,422

(22) Filed: Mar. 13, 2014

(65) Prior Publication Data

US 2015/0253092 A1 Sep. 10, 2015

(30) Foreign Application Priority Data

Mar. 14, 2013 (IL) ..... 225229

(51) Int. Cl.
*F41A 9/60* (2006.01)
*F41A 9/56* (2006.01)
*F41A 27/18* (2006.01)

(52) U.S. Cl.
CPC *F41A 9/60* (2013.01); *F41A 9/56* (2013.01); *F41A 27/18* (2013.01)

(58) Field of Classification Search
CPC .... F41A 15/00; F41A 9/79; F41A 9/81; F41A 9/60; F41A 9/56; F41A 27/18
USPC ..... 89/33.4, 1.1, 37.01, 37.03, 37.17, 41.01, 89/41.02; 42/98
See application file for complete search history.

(56) References Cited

U.S. PATENT DOCUMENTS

| | | | | |
|---|---|---|---|---|
| 2,149,522 A | | 3/1939 | Haberlin | |
| 2,336,557 A | * | 12/1943 | McCallister | B64D 7/02 114/15 |
| 2,365,578 A | * | 12/1944 | Morin | F41A 9/54 160/127 |
| 2,400,385 A | * | 5/1946 | Blaylock | F41A 27/18 89/33.4 |
| 2,415,153 A | | 2/1947 | Trimbach | |
| 2,956,480 A | | 10/1960 | Zouck | |
| 4,583,444 A | * | 4/1986 | Jackson | F41A 27/16 89/36.08 |
| 6,250,197 B1 | * | 6/2001 | Sanderson | B64D 7/02 89/37.16 |
| 6,286,411 B1 | * | 9/2001 | Sanderson | F41A 23/20 89/37.03 |

(Continued)

FOREIGN PATENT DOCUMENTS

| | | |
|---|---|---|
| EP | 0141018 | 5/1985 |
| GB | 703320 | 2/1954 |
| GB | 725595 | 3/1955 |

*Primary Examiner* — Jonathan C Weber
(74) *Attorney, Agent, or Firm* — Rodney J. Fuller; Booth Udall Fuller, PLC

(57) ABSTRACT

Spent cartridges router means in a configuration of a four bars or four bar linkage mechanism for routing spent cartridges ejected from a chain fed automatic weapon towards means for gathering cartridges that is installable as an ad-on and independent (stand alone) mechanism on a weapon station of the type that comprises a base assembly that is rotatable for traverse motion, a cradle assembly that is located on the base assembly and linked with it in axial (pivotally) manner and chain fed automatic weapon that is affixable on the cradle assembly in a manner that it will be rotatable for elevation and lowering around the cradle's axis.

8 Claims, 8 Drawing Sheets

(56) References Cited

U.S. PATENT DOCUMENTS

Figure 1:
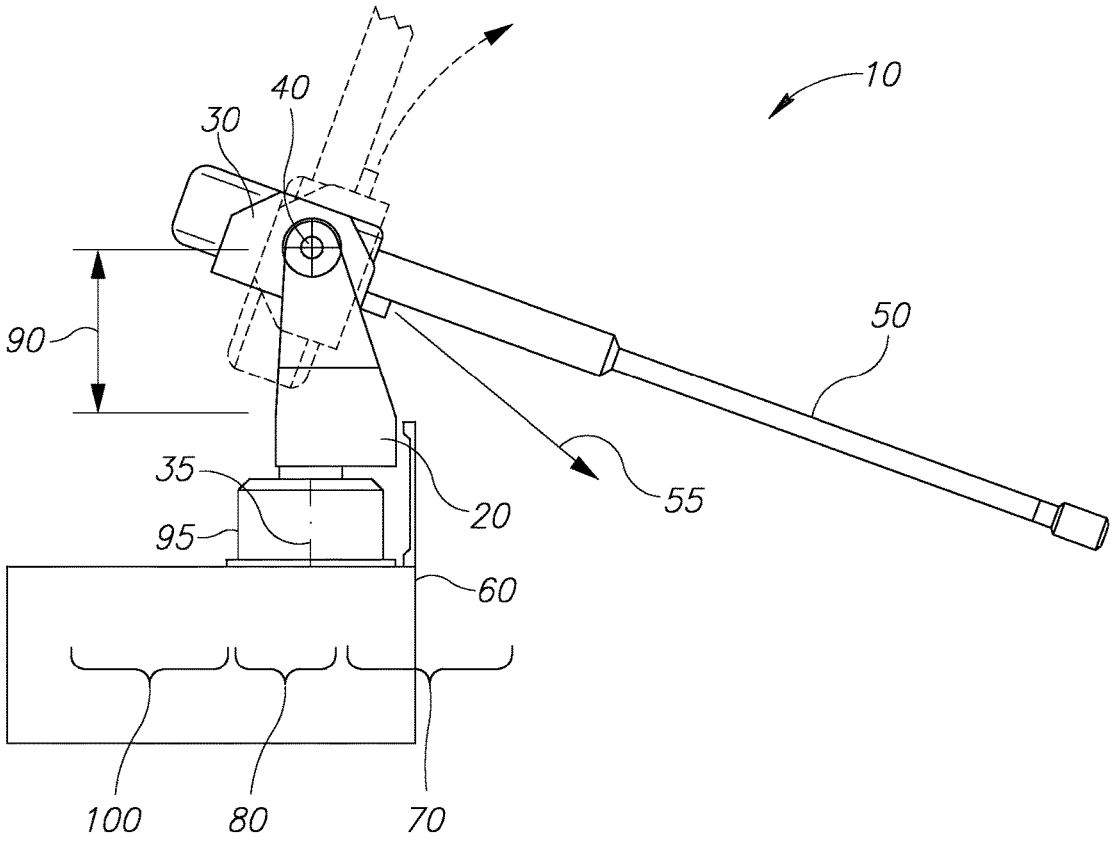
FIG.1 PRIOR ART

| | | | | |
|---|---|---|---|---|
| 6,293,179 | B1 * | 9/2001 | Sanderson | B64D 7/02 89/37.03 |
| 7,258,055 | B1 | 8/2007 | Javorsky | |
| 8,069,767 | B2 * | 12/2011 | Deckard | B64D 7/06 42/98 |
| 8,151,684 | B2 | 4/2012 | Buechler | |
| 8,434,397 | B1 * | 5/2013 | Deckard | B64D 7/06 89/37.13 |
| 8,850,950 | B2 * | 10/2014 | Deckard | B64D 7/06 89/136 |
| 2010/0294119 | A1 * | 11/2010 | Buechler | B64D 7/06 89/33.2 |
| 2010/0294120 | A1 * | 11/2010 | Deckard | B64D 7/06 89/33.4 |
| 2010/0319521 | A1 * | 12/2010 | Dick | F41A 9/56 89/33.2 |
| 2014/0060309 | A1 * | 3/2014 | Deckard | B64D 7/06 89/136 |

* cited by examiner

SPENT CARTRIDGES ROUTER

CROSS-REFERENCE TO RELATED APPLICATIONS

This application claims the benefit of priority from Israel Patent Application No. 225229, filed Mar. 14, 2013, the content of which is incorporated herein by reference in its entirety.

FIELD OF THE INVENTION

The present invention, the subject matter of this patent application, is found in the field of mechanisms for routing the spent cartridges that are ejected from chain fed automatic weapons, routed towards means for collecting them in general, and especially—within the domain of such mechanisms that are embodied (implemented) in weapon stations of the turret genre and that constitute a rotating weapon station with capability of angular lowering and elevating the barrel of the weapon as well as traverse (lateral movement)—inclusive of Remote Controlled Weapon Stations (herein after: RCWS).

BACKGROUND OF THE INVENTION

Well known and familiar are weapon stations of the rotating turret genre in which an automatic weapon (one or more) are mounted, wherein the station enables both traverse movement of the weapon in the plane as well as angles of lowering or elevating the barrel of the weapon.

Such stations that constitute RCWS units are also known and familiar. RCWS is a weapon station that is usually (mostly) mounted on a self propelled platform (for example—on a watercraft or an armored combat vehicle). By means of providing a joystick, video display and operating console, the RCWS comprises all the functions which enable it to acquire targets, aim the weapon and fire at a target with high accuracy. The gunner operates while he is within the platform hull and is protected by the platform's armor, even though there exists also RCWS entities that enable a manual operation mode of the RCWS.

Chain fed automatic weapons that are mounted in such stations may also be fast firing automatic guns (cannons), for example—Hughes M230 30 mm chain gun or Alliant Techsystems Mk 44 Bushmaster II 30 mm chain gun or M242 bushmaster 25 mm chain-fed auto canon.

From the instant of firing by such automatic weapons, there exists ejection of spent cartridges from the automatic weapons that is taking place from the ejection opening that is formed in them, downwards or forward (ahead) parallel to the firing axis, in accordance with the automatic weapon being used (for the sake of completeness let it be noted that concurrently, through another opening of the weapon, the links of the chain that became empty are also ejected).

Because we are referring to automatic weapons that have a relatively high rate of fire and also relatively large caliber, then from the firing instant a substantial amount of cartridges that are of relatively large volume and weight are ejected from the automatic weapons during a short time period.

The accumulation of spent cartridges in the weapon station or its vicinity can cause a safety problem. For example, when the weapon station is located on a deck of a vessel, the accumulation of spent cartridges on the deck can expose the seamen to danger of being hit or of skidding due to encountering them.

The ejection of cartridges is also liable to impose packaging restrictions from the point of view of positioning the weapon stations. For example, when considering a watercraft that is equipped with a helicopter's landing pad, then the ejected cartridges are liable to hit in their trajectory a rotor of the helicopter, hence it is imperative to provide adequate distance between the weapon station and the landing pad.

All this and more, considerations of allowing maximum free area on the deck (space efficiency), compel positioning the weapon stations near as much as possible to the edge of the deck. The catch is that in such preferred configuration, ejection of the cartridges can lead them to be thrown off the deck, namely to the sea, in a manner that results in an environmental hazard.

Hence, there are known and familiar means and mechanisms for collecting spent cartridges (and chains' links) that are ejected by the chain fed automatic weapons. Thus for example, usage is made of crates and sacks that are located adjacent to the ejecting openings of the weapons, in a manner that the ejected cartridges fall into them (by gravitational force) or led to them by an array of chutes (flexible, rigid, or in a combination of flexible and rigid chutes) or by a relative complex means (hence expensive) for conveying empty cartridges on a propelled conveyer.

Various means for routing and collecting spent cartridges at weapon stations are described inter alia in the following patents: U.S. Pat. No. 8,151,684, U.S. Pat. No. 7,258,055, U.S. Pat. No. 2,956,480, U.S. Pat. No. 2,149,522, and U.S. Pat. No. 2,415,153, EP 141018, GB 725595, and GB 703320. The problem is that using these means might hamper and contradict the optimized design of the weapon stations.

Reference is made to FIG. 1. FIG. 1 constitutes a schematic illustrated example of a typical (characteristic) RCWS 10 that would serve us for demonstrating some of the restrictions that designers of means for routing and collecting ejected cartridges in an RCWS are faced with.

As a characteristic RCWS, RCWS 10 comprises a base assembly 20 that is rotatable to perform traverse type action around traverse axis 35, cradle assembly 30 that is positioned on the base assembly wherein it is connected to it in an axial mode (see axis 40) and chain fed automatic weapon 50 (the chain is not illustrated), that is affixed on cradle assembly 30 in a manner that it will be movable in rotatable motion for lowering and elevating operation around the cradle's axis 40.

In the illustrated example, weapon 50 ejects its spent cartridges in a forwards direction (in parallel to the firing axis)—see the arrow marked 55 in the figure.

Any professional in this field would understand that hanging sacks or other means for collecting spent cartridges, and this directly on cradle assembly 30, is liable to weigh heavily on the control requirements. The dynamic accumulation of relatively heavy cartridges within such collecting means would encumber the required control loop that is required for propelling and stabilizing the cradle and would mandate its dynamic updating by continuance feedback.

Another example—when the desirable location of RCWS 10 is given for the maritime configuration, at which we have already pointed at above (as near as it is possible to the edge 60 of the deck area), when we are referring to an automatic weapon as said, in which the ejection of the cartridges is forward (in parallel to the firing axis), then in the absence of an early backwards routing of the ejected cartridges, the collection of the cartridges at the front of the weapon station (in the area marked 70), is liable to pose a safety problem—to expose the personnel (the crew) that is designated to evacuate and empty the cartridges from the collection means, to the naturally, dangerous proximity of the deck's edge 60.

An additional example—routing the ejected cartridges to the region (area) that is directly under the weapon (in the region marked 80) and collecting them there, are liable to be a burden on the compact design of the weapon station. In order that that positioning of the cradle's axis 40 would indeed provide for the required collecting space and without harming the lowering/elevating capability of the weapon, such configuration is liable to compel non-desired increase of the station's height dimension (ibid, the dimension marked 90), especially so because commonly, in a characteristic RCWS, the space located under the cradle is allocated for packaging of the RCWS propelling means and control assemblies (see means 95).

Another example—even when trying to route the ejected cartridges to the rear section of the station (to the region marked 100) for being collected there, then—when an automatic weapon is considered, as said, in which the ejection of the cartridges is directed forward, (in parallel to the firing axis), elevating it unto a relatively high angle (for example 80°, see the condition marked by a broken dashed line) posts a challenge of routing the ejected cartridges from a geometrical point of view. Selecting an array of chutes—even flexible ones as a solution, would compel to overcome the need to propel the cartridges being ejected in a path (trajectory) that bypasses cradle assembly 30, (because that from the instant of elevating the cradle assembly as said—the cradle assembly 30 would be positioned between the cartridges ejection opening to the desired collection area 100 which is geometrically located in the stern area of the weapon station) or alternatively to limit the elevating angle that the weapon station provides for the weapon.

Thus, at the time (period) that preceded the invention that is the subject matter of this present application, there existed in the field of weapon stations a need of providing a reliable and relatively low priced solution to the challenge of routing and collecting the ejected cartridges. This, while maintaining the compact dimensions of the weapon station, providing capability of achieving relatively large (high) elevation angle of the weapon, without letting the routing and collecting of the ejected cartridges solution disturb and put a burden on the elevating and lowering axis, a solution that enables positioning the weapon station even at the edge of a platform's deck, and wherein the solution for routing and collecting the ejected cartridges does not require propelling or control means, namely it is a rather stand alone independent add-on means, i.e., an inert added means that does not rely on the weapon and the firing run for executing its tasks and does not compel timing with it.

SUMMARY OF THE INVENTION

The invention, the subject matter of this patent application, responds to the need that we have pointed at above, by providing a means for routing cartridges which is based on a mechanism known in the mechanical engineering design field as four bar mechanism (or four bar linkage).

According to one aspect of the invention, in a weapon stations that comprises a base assembly that is rotatable for traverse action, a cradle assembly that is located on the base assembly and linked to it in an axial manner and chain fed automatic weapon, that is amenable to be affixed on the cradle assembly in a manner that it will be capable of rotatable movement for lowering and elevation of the weapon around the axis, and wherein the weapon is of the type that when rounds are fired from it, the empty cartridges are ejected from it downwards or forward, there is installed a mechanism known as four bar mechanism (dubbed also four bar linkage) for routing the cartridges being ejected from the weapon towards a means for collecting the cartridges.

In a preferred configuration of the invention, the four bar (or four bar linkage) mechanism comprises a moveable routing assembly that is axially linked to the cradle assembly at a distance from the elevating and lowering axis, in a manner that from the instant of propelling the cradle assembly to elevating or lowering operation, it constitutes the crank of the mechanism, while the moveable routing assembly constitute the connecting rod of the mechanism. In addition, this means includes a moveable arm assembly wherein on its one end it is axially linked to the base assembly and on its other end it is axially linked to the moveable routing assembly, in a manner that from the instant of propelling the cradle assembly to elevating or lowering operation it constitutes the rocker element of the mechanism, and a static routing assembly that is positioned on the base assembly in a manner that from the instant of propelling the cradle assembly to elevating or lowering—the moveable routing assembly is propelled to move over it.

In accordance with this preferred configuration of the invention, from the instant of firing from the weapon, the moveable routing assembly is suited to receive the cartridges from the instant of their ejection from the weapon and to route them for movement by the gravitational force towards the static routing assembly, that continues and routes them to continue moving by the gravitational force, towards the means for collecting cartridges.

In a different and additional aspect of the invention, the invention constitutes means in the configuration of a four bar (or a four bar linkage) mechanism for routing cartridges ejected from a chain fed automatic weapon towards a cartridges collecting means, that is installable add-on as an independent stand alone means, on various weapon stations in general and on RCWS units in particular.

It is to be understood that both the foregoing general description and the following detailed description are just exemplary and explanatory and are intended to provide further explanations of the invention as claimed.

BRIEF DESCRIPTION OF THE ACCOMPANYING FIGURES

Examples illustrative of embodiments of the invention are described below with reference to figures attached hereto. In the figures, identical structures, elements or parts that appear in more than one figure are generally labeled with the same numeral in all the figures in which they appear. Dimensions of components and features shown in the figures are generally chosen for convenience and clarity of presentation and are not necessarily shown to scale.

FIG. 1 constitutes, as said, a schematic illustration of a typical (characteristic) RCWS, that in the "Background of the invention" chapter served us for demonstrating some of the restrictions that face the designers of means for routing and collecting ejected cartridges in an RCWS.

Figure 2:
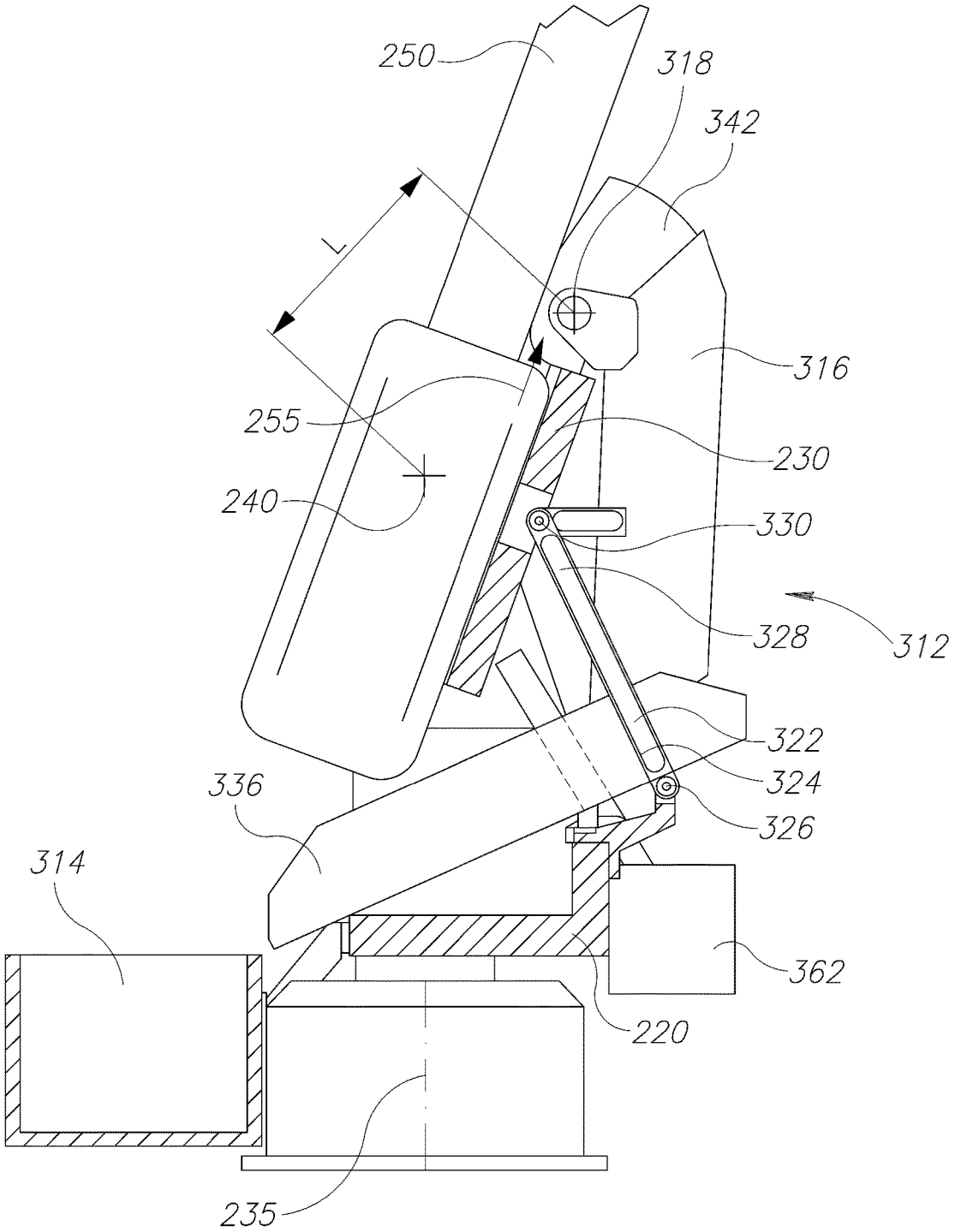

FIG. 2 constitutes a schematic illustration of a cross section view of an RCWS in which there is installed a means for routing cartridges in accordance with the invention wherein the cradle assembly of the RCWS is found in an elevation position.

Figure 3:
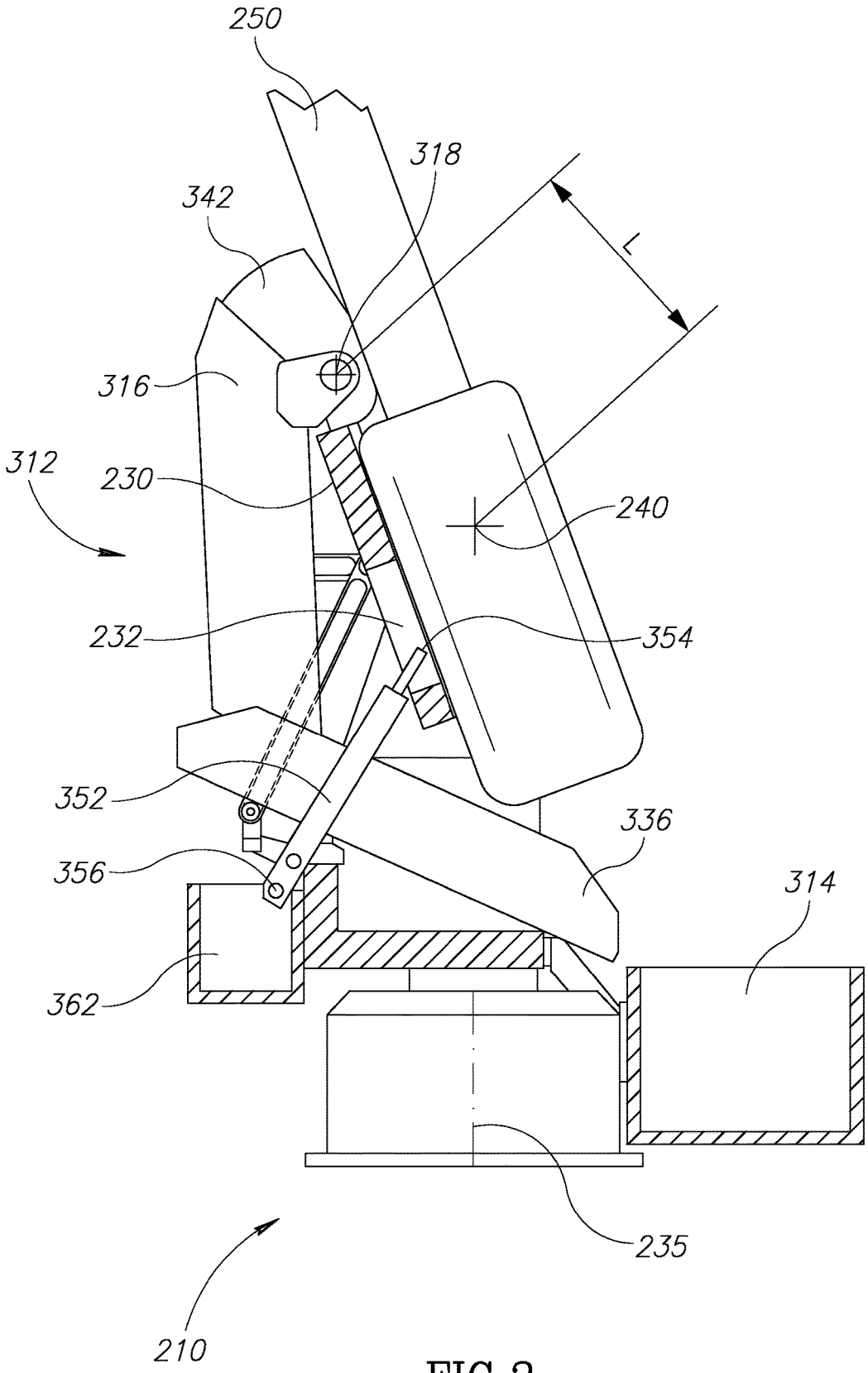

FIG. 3 constitutes an additional cross section view of the RCWS that is illustrated in FIG. 2 wherein it is rotated by 180° around the traverse axis.

Figure 4:
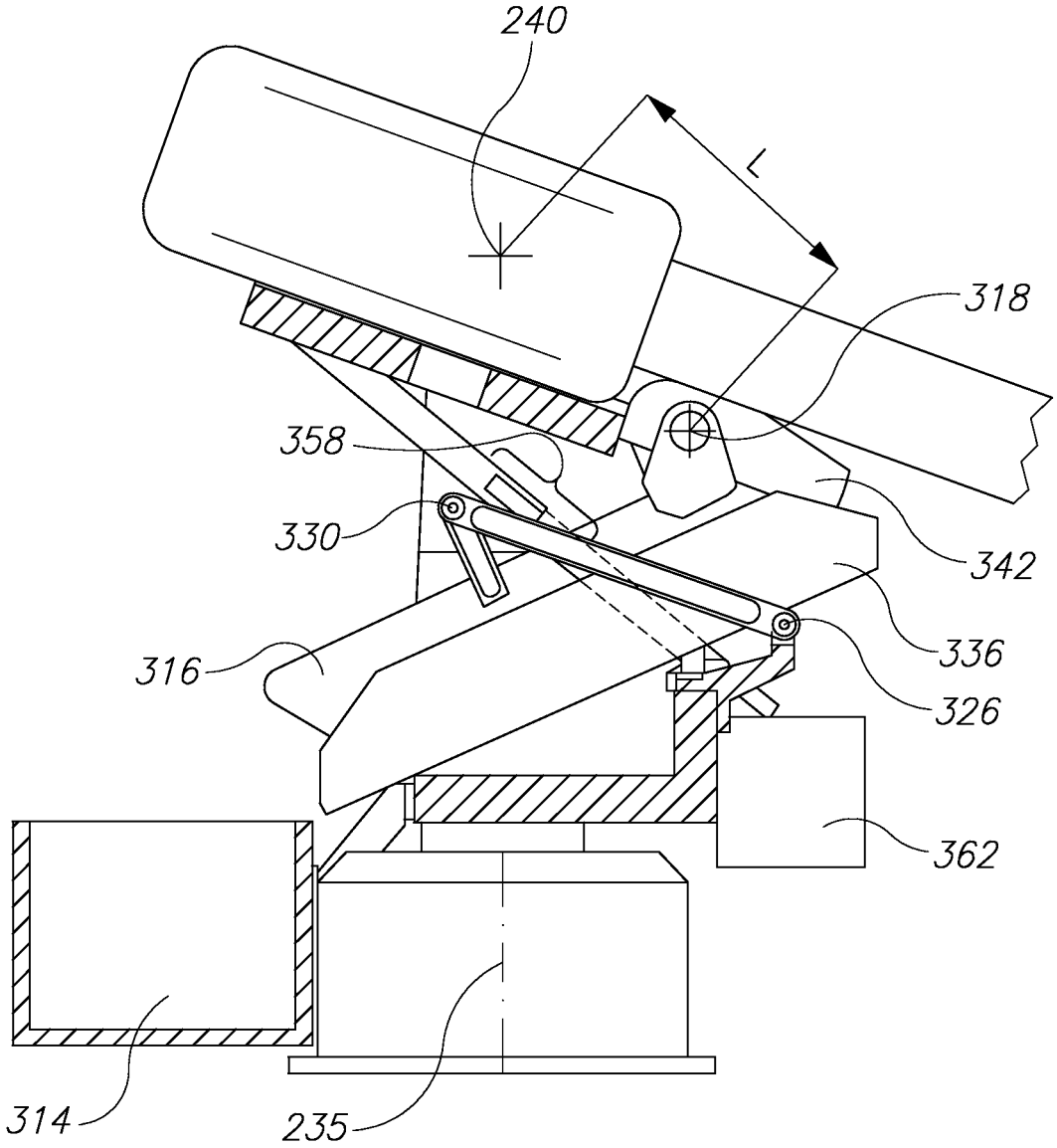

FIG. 4 constitutes a schematic illustration of the RCWS that is illustrated in FIGS. 2 and 3, wherein the cradle assembly is found in a lowering position.

Figure 5:
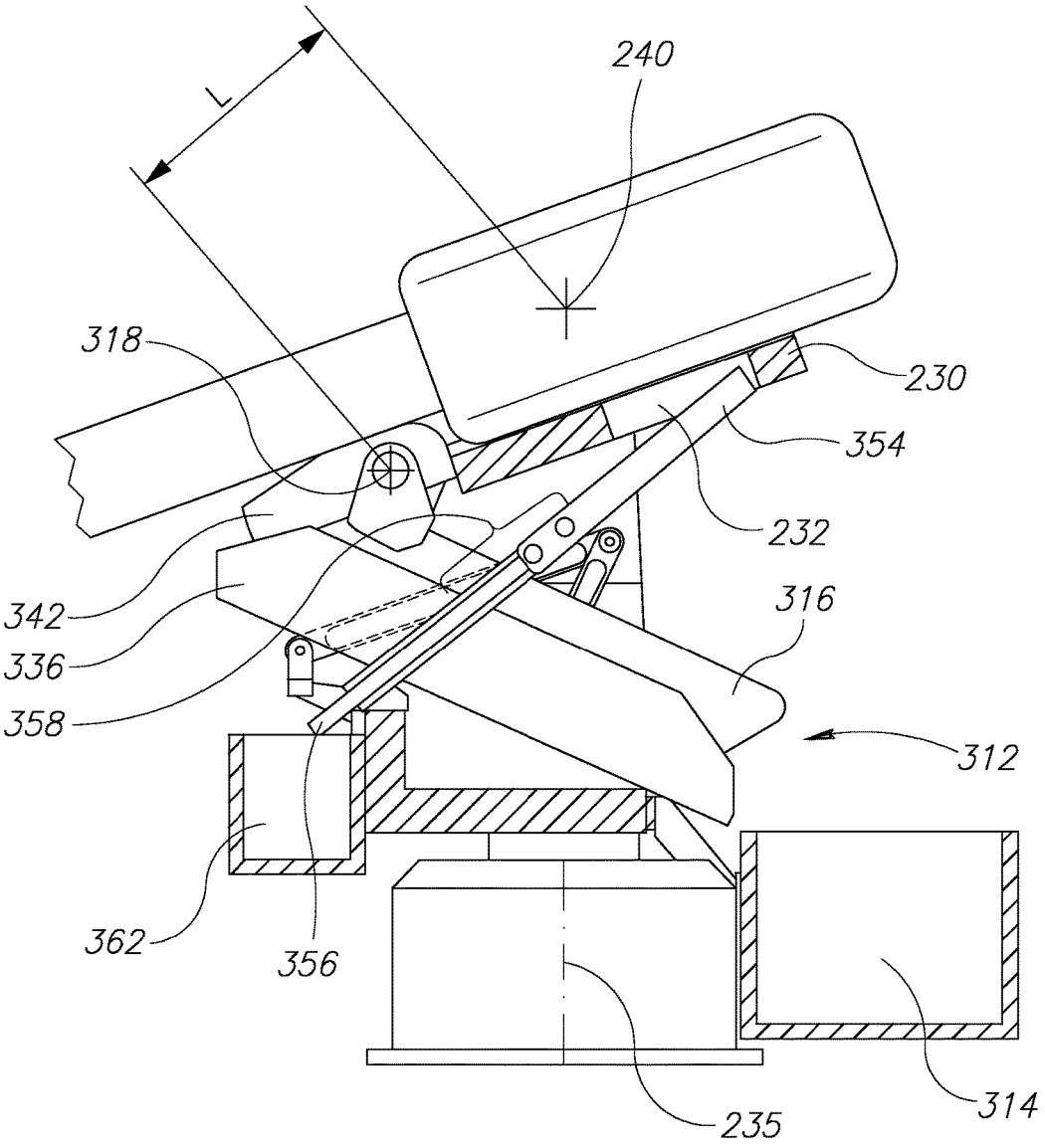

FIG. 5 constitutes an additional schematic illustration of the RCWS that is illustrated FIG. 4 wherein it is rotated by 180° around the traverse axis.

Figure 6:
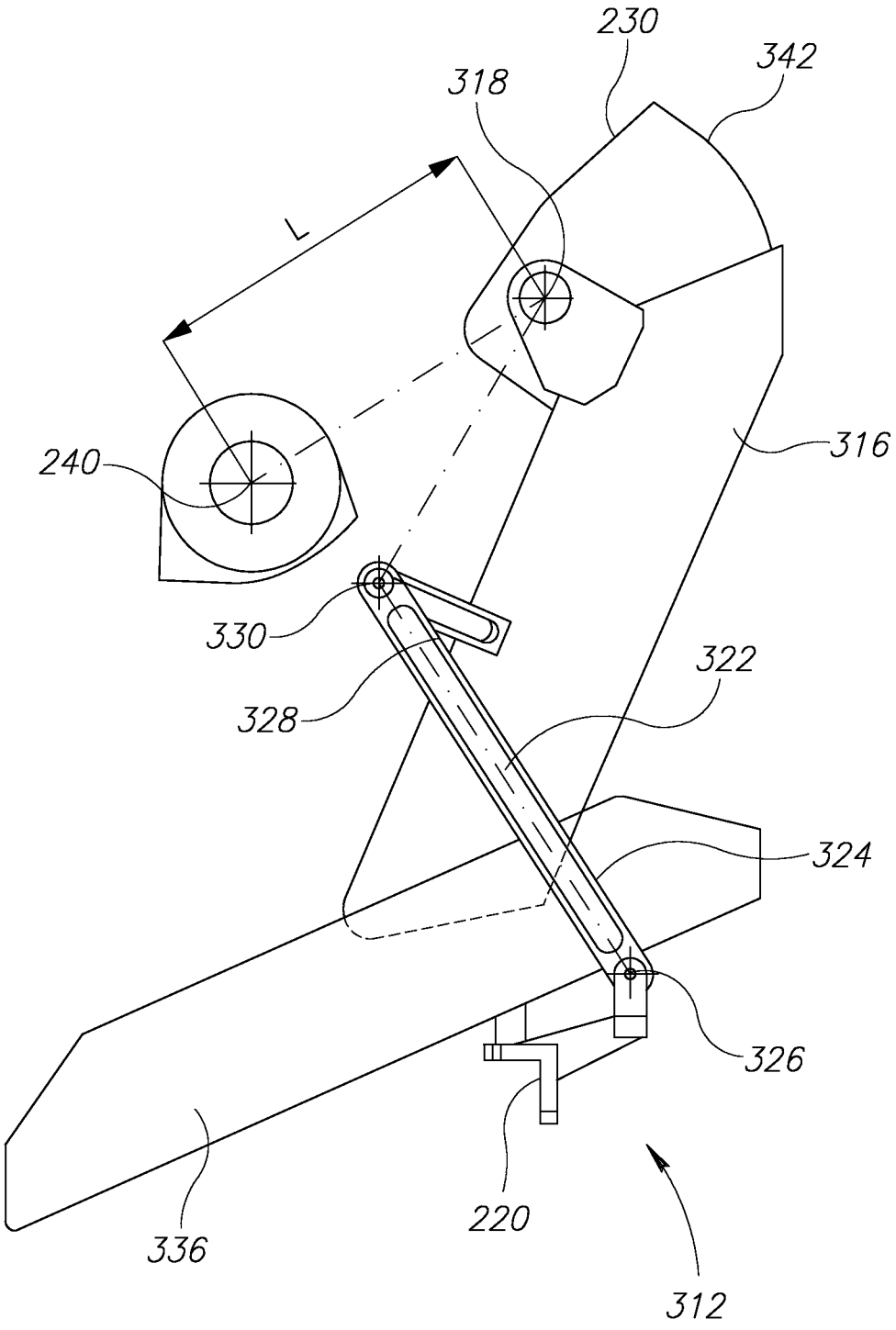

FIG. 6 constitutes a schematic illustration that simplifies the means for routing cartridges that is illustrated in FIGS. 2 to 5 as it is installed in an RCWS, up to a four bar or four bar linkage mechanism.

Figure 7:
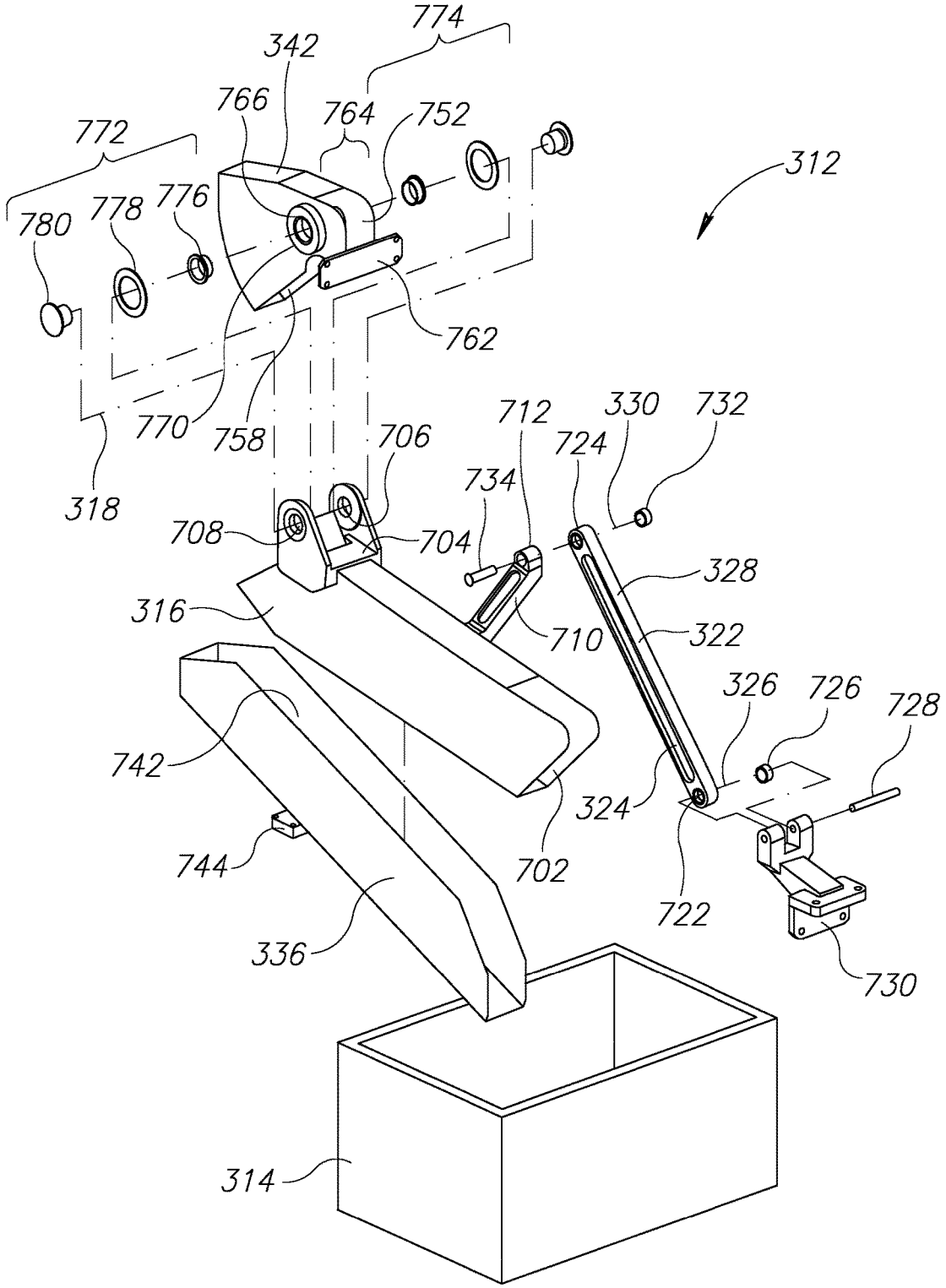

FIG. 7 constitutes an exploded view of the components of a means for routing cartridges as the one that was illustrated in a schematic mode in FIGS. 2 to 6.

Figure 8:
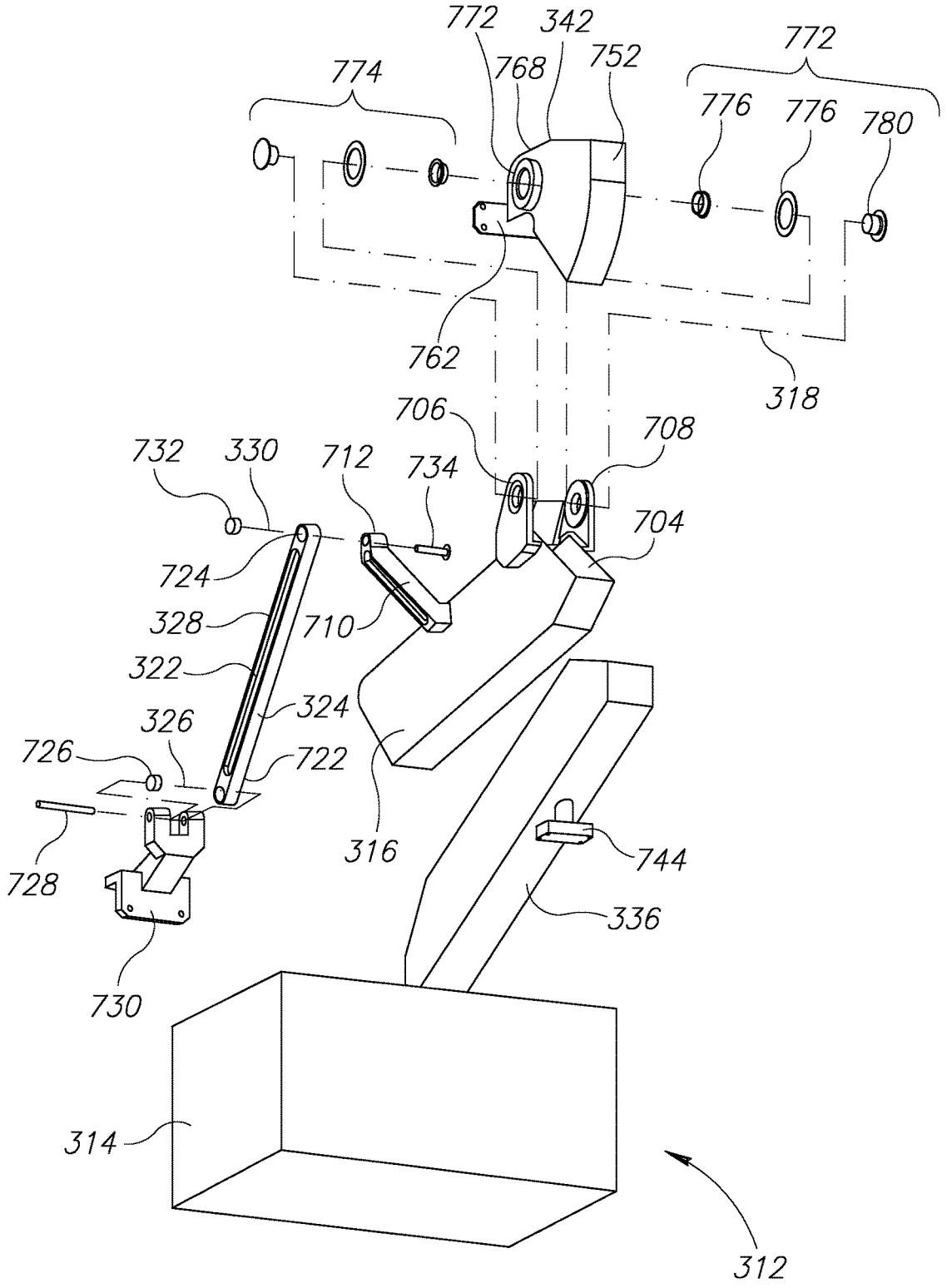

FIG. 8 constitutes an additional, and from a different angle, exploded view of the components of the means for routing cartridges that were illustrated in FIG. 7.

DETAILED DESCRIPTION OF A SAMPLE CONFIGURATION OF THE INVENTION

Reference is made to FIGS. 2 to 5. FIG. 2 constitutes a schematic illustration of a cross section view of an RCWS 210 in which there is installed a means 312 for routing cartridges in accordance with the invention wherein the cradle assembly 230 of the RCWS is found in an elevation position. FIG. 3 constitutes an additional cross section view of RCWS 210 wherein it is rotated by 180° around traverse axis 235. FIG. 4 constitutes a schematic illustration of RCWS 210 wherein cradle assembly 230 is found in a lowering position. FIG. 5 constitutes an additional schematic illustration of RCWS 210 wherein it is rotated by 180° around traverse axis 235.

As a typical RCWS, RCWS 210 comprises a base assembly 220 that is rotatable around traverse axis 235, cradle assembly 230 that is positioned on the base assembly 220 wherein it is axially linked with it for lowering or elevating movement around axis 240 and chain fed automatic weapon 250 that is illustrated wherein it is affixed on cradle assembly 230, in a manner that it will be rotatable for elevation and lowering movements around axis 240.

In the illustrated example, weapon 250 is of the kind that from the instant that firing from it was executed, the empty cartridges (that are not illustrated) are ejected forward from it in parallel to the firing axis (see the arrow marked 255).

In accordance with the invention, RCWS 210 comprises in addition, means 312 for routing the cartridges being ejected from weapon 250 towards means 314 for collecting the cartridges (means for collecting spent cartridges that in the illustrated example is positioned on base assembly 220 at the rear section of RCWS 210).

Means 312 for routing the cartridges comprises a moveable routing assembly 316 that is linked in an axial manner to cradle assembly 230 (see axis 318), at a distance away from the elevating and lowering axis 240 (see distance L). Means 312 comprises in addition (see FIGS. 3 and 5), a moveable arm assembly 322 wherein at one of its ends —324, is axially connected to base assembly 220 (see axis 326), and at its other end —328, it is axially connected to moveable routing assembly 316 (see axis 330). Means 312 comprises in addition, a static routing assembly 336 that is positioned on base assembly 220 in a manner that from the instant of propelling cradle assembly 230 unto elevating or lowering, moveable routing assembly 316 is propelled for movement over assembly 336 (and in the illustrated configuration, also partially integrates for sliding in it).

Thus, from the instant of actually firing from weapon 250, moveable routing assembly 316 is suited to receive the spent cartridges from the instant that they are being ejected from the weapon and to route them to movement by the gravitational force towards static routing assembly 336. Any professional would understand that in accordance with the invention, the moveable routing assembly always maintains a negative angular orientation in relation to the angular condition of the cradle, in a manner that enables the sliding of the cartridges by the gravitational force downwards and backwards (towards the area in the rear). Static routing assembly 336 preserves and continues routing the spent cartridges towards continued movement by the gravitational force towards means 314 for collecting the cartridges.

In the illustrated example, cradle assembly 230 comprises means 342 for absorbing the ejected cartridge upon ejection and directing it towards moveable routing assembly 316. Means 342 serves also as a bracket for axial linking as said (by means of axis 318) of moveable routing assembly 316 to cradle assembly 230. Ejection of the cartridges from weapon 250 crosses in its direction axis 318 that is axially linking moveable routing assembly 316 to cradle assembly 230. In terms of relative dimensions, means 342 and moveable routing assembly 316 are formed in a manner that the anticipated movement trajectory of the cartridge is large enough in order to prevent the cartridges from being stuck in any spatial position (the anticipated trajectory of the cartridges is formed in dimensions that are larger than a geometrical circle that can bound the cartridge).

Thus, any professional would understand that it is feasible to adapt an existing cradle assembly of a weapon station to receiving means for routing cartridges in accordance with the invention, and this by a simple mounting of an adapter means on the existing cradle assembly—means 342 in accordance with the illustrated example.

Furthermore and in accordance with the illustrated example, RCWS 210 comprises in addition also means 352 for routing the empty links of the (feeding) rounds chain (that are not illustrated), from weapon 250. in the illustrated example, the empty chain links are ejected from a lower ejection opening that is formed in the weapon in a location that is slightly moved away from its cartridges ejection axis and pass through opening 232 that is formed in cradle assembly 230 (see FIGS. 5 and 6), towards means 362 for gathering links (means for gathering links that in the illustrated example is located on base assembly 220). Means 362 for gathering links is a surface (pallet) for sliding the links, wherein one of its ends —354, is axially connected to the cradle assembly 230 and its other end —356, is axially connected to base assembly 220, and it contains a telescopic mechanism for automatically adapting its length from the instant of (actually) propelling the cradle assembly 230 for elevation or lowering positions.

Thus, any professional would understand that installing a weapon station with mean for routing spent cartridges that will be in accordance with the invention, enables also treating concurrently the empty chain links that are also ejected from the weapon, in a manner of routing them to a separate collection means while using for this purpose a specific dedicated means—means for routing the chain links—means 352 as per the illustrated example.

Reference is being made to FIG. 6. FIG. 6 constitutes a schematic illustration that simplifies means 312 for routing cartridges that is illustrated in FIGS. 2 to 5 as it is installed in RCWS 210 up to a four bar or four bar linkage mechanism which is familiar to any mechanical engineer.

Any mechanical engineer would understand that the design of means 312 is solely a special case of the four bar or four bar linkage mechanism.

Moveable routing assembly 316 is axially connected (see axis 318) to cradle assembly 230 (that in the illustrated example, means 342 constitutes a part of it) and this—at a distance L from the elevating and lowering axis 240 of cradle assembly 230 and in a manner that from the instant of propelling cradle assembly 230 for elevating or lowering, the distance L constitutes the crank of the mechanism, a crank element that in our case, during its rotational movements does not execute a complete circle but only an angular movements, while moveable routing assembly 316 constitutes the connecting rod element of the mechanism.

Moveable arm assembly 322 at one end of it —324, is axially linked (see axis 326) to base assembly 220 and on its other (second) end —328, it is axially linked (see axis 330) to moveable routing assembly 316, in a manner that from the instant of propelling cradle assembly 230 for elevating or lowering constitutes the rocker element of the mechanism.

Static routing assembly 336 is positioned on base assembly 220 in a manner that from the instant of propelling cradle assembly 230 to elevating or to lowering, moveable routing 316 is propelled for motion over it (in the illustrated example, with partial integration of moveable routing assembly for sliding within static routing assembly).

Thus, as said, any professional in the profession of mechanical engineering would classified the engineering design of means 312, as a specific (special) case of the four bar or four bar linkage mechanism, wherein the crank of the mechanism does not execute a complete turn (circle) but only an angular movement and in a manner that it is viable to designate (or nickname) the mechanism also as a double rocker type of four bar or four bar linkage mechanism, Reference is made to FIGS. 7 and 8. FIG. 7 constitutes an exploded view of the components of a means for routing cartridges as the one —312, that was illustrated in a schematic mode in FIGS. 2 to 6. FIG. 8 constitutes an additional, and from a different angle, view of the components of the means for routing cartridges that are illustrated in FIG. 7.

Moveable routing assembly 316 that serves, as said, as the connecting rod element of the mechanism, is formed as a conduit (canal) 702 equipped with front and rear openings that enable passage of the cartridges through it. Conduit 702 is formed in dimensions large enough in order to prevent cartridges from being stuck in it in any cartridge spatial orientation (conduit 702 is formed in dimensions larger than the geometrical circle that can bound the cartridge). Conduit 702 is manufactured for example by bending tin sheets. Conduit 702 is liable to be coated by a suiting low friction providing coating material for facilitating the sliding of the cartridges through it. The assembly includes also bracket 704 that is formed at its front end and serves as a basis for the axial linking of the assembly with the cradle assembly. Bracket 704 is formed in a U shaped configuration, for example by machining techniques. Axis 318 is formed inside it (in a configuration of two openings —706. 708). From the-instant of affixing bracket component 704 to conduit component 702 (for example by welding or by using screws), axis 318 is orthogonal in its direction in relation to the passage that is enabled by conduit 702.

The assembly comprises also bracket 710 that is formed as it protrudes from its middle and serves as a basis for the axial linking of the assembly with moveable arm assembly 322. Bracket 710 is formed for example by machining techniques. Axis 330 is formed in it (in a configuration of opening 712). From the instant of affixing bracket 710 to conduit 702 (for example by welding or by using screws), axis 330 is parallel in its direction to axis 318 (and hence both of them are orthogonal in their direction, relative to the passage that conduit 702 is enabling).

Moveable arm assembly 322 that serves, as said, as the mechanism's rocker element, is formed as an elongated pole, for example—by machining techniques. Axis 326 is formed in arm 322 in a configuration of an opening 722 that is formed in the one end —324 of the arm and suited to serve as a bracket for the axially (pivotally) linking of the arm to the base assembly. Axis 330 is formed in arm 322 in the configuration of an opening 324 that is formed at the other end —328, of the arm, and is suited to serve as a bracket for the axially linking of the arm with the moveable routing assembly.

In the illustrated example, the axially (pivotally) linking of moveable arm assembly 322 to the base assembly is carried out through bearing 726 (for example balls' bearing or sliding bearing made of a polymeric material) that is suited for affixing in opening 722 and a pin 728 that is suited to be installed in it when the bearing is sliding over it. Pin 728 is suited for being affixed inside bracket 730 that is affixed unto the base assembly (that is not illustrated), (for example with screws) and constitutes a part of it.

In the illustrated example, the axial linking of moveable arm 322 to moveable routing assembly 316 is carried out through bearing 732 (for example balls' bearing or sliding bearing made of a polymeric material) that is suited for affixing in opening 724, and pin 734 that is suited for being installed within (inside) opening 712 that is formed in bracket 710 that from the instant of affixing it to conduit component 702 constitute a part of the moveable arm assembly.

Static routing assembly 336 is formed as an open conduit 742 that has a characteristic cross section similar to the letter U that enables passage of the ejected cartridges through it. In the illustrated example, the letter U resembling conduit opening is suited in its dimensions to receive (accept) into it conduit 702 of moveable routing assembly 316. Conduit 742 is produced for example by a method of bending tin sheets. Conduit 742 is liable to be coated with an adequate low friction coating material in order to facilitate the sliding of the cartridges through it. In the illustrated example, conduit 742 is given to be mounted on the base assembly (that is not illustrated), through adopting bracket 744 that anchors the conduit unto the base assembly (for example by screws (that are not illustrated)).

Means 312 for routing the cartridges includes in addition means 342 that is installable on the cradle assembly (that is not illustrated), and serves also as a bracket for the purpose of axially (pivotally) linking as said, moveable routing assembly 316 to the cradle assembly. Means 342 is formed as a kind of a box 752 with an internal space 754 and openings —756 and 758. Box 752 is manufactured—for example, by bending tin sheets. Box 752 is formed with a flange surface 762 (plane) that serves for affixing it to the cradle assembly (that is not illustrated), for example using screws (that are not illustrated). Opening 756 is suited for passage of the spent cartridge through it from the instant of being ejected from the weapon (that is not illustrated). Inner space 754 is suited by its dimensions for diverting the cartridge towards opening 758. Inner space 754 or at least opening 758 are formed in dimensions that are large enough to prevent the cartridges from getting stuck in them in any spatial orientation of the cartridge (inner space 754 and opening 758 are formed in larger dimensions than those of the bounding circle of such cartridge). Inner space 754 is liable to be covered with an adequate low friction coating material for facilitating the sliding of the cartridges through it. The walls of box 752 in the area of opening 756 are formed as bracket 764 that serves as a base for the axial linking of the moveable routing assembly with the cradle assembly. Bracket 764 comprises two bushings (sleeves)—766, 768 that are affixed at the walls of the box (for example bushings that are manufactured by machining and are than (later) anchored to the walls by welding). Axis 318 is formed in them (in the configuration of two openings —770, 772). The U shaped opening of bracket 704 is suited in its dimensions to receive into it bracket 764.

In the illustrated example, the axially (pivotally) linking of moveable routing assembly 316 to means 342 (and actually from the instant of affixing means 342 to the cradle assembly—pivotally linking moveable routing assembly 316 to the cradle assembly), is provided through two arrays 772, 774 that comprise, each one of them, bearing 776 (for example—sliding bearing made of a low friction polymer), that is suited to being affixed in the openings 770, 772 of the bushings, a spacer disc 778 (for example—disc shaped element made of a low friction polymer) that is suited to be installed in the gaps between the U shaped configuration of bracket 704 to bracket 764 and a pin 780 that is suited be installed inside the bearing wherein the bearing is adapted to slides over it. Pin 780 is suited to be affixed inside openings 706, 708 of bracket 704. It is to be emphasized that from the instant of its installation, pin 780 does not protrude into the inside of opening 756, or at least does not protrude in a manner that it blocks the path of the ejected cartridges being ejected into inner space 754.

In the illustrated example, from the instant of installing means 342 on the cradle assembly (that is not illustrated), the ejected cartridge will cross in its direction the linking axis 318 situated between moveable routing assembly 316 to the cradle assembly.

Thus, from the instant of assembling the components of means 312 and propelling the cradle assembly (that is not illustrated) to elevating or lowering, moveable routing assembly 316 is propelled to perform movements over the static routing assembly 336 while partially being integrated into it and slide inside it (see FIGS. 2 to 6). From the instant of (actually) firing from the weapon that is mounted on the cradle assembly, the ejected cartridges pass through opening 754 of means 342, are diverted towards its opening 756 and from there (by the gravitational force) continue their trajectory inside conduit 702 of moveable routing assembly 316 that routes them to move towards conduit 742 of static routing assembly 336 that continues and routes them towards means 314 for gathering cartridges (that for the sake of the example is illustrated in FIGS. 7 and 8 merely as a box).

Any professional would understand that in accordance with the invention, the components of means 312 as they were described above while referring to FIGS. 7 and 8 create—from the time that they were assembled, a configuration of a mechanism known as four bar mechanism (or four bar linkage) for routing cartridges being ejected from a chain fed automatic weapon (that is not illustrated) towards a means for gathering cartridges. A mechanism that is installable on weapon stations as an ad-on and independent (stand alone) means.

Any professional would also understand that, notwithstanding the fact that the mechanism was described above and illustrated while referring to weapons that the ejection of cartridges from them is executed forwards (towards the front and parallel to the firing axis), then by slight (easy) and simple adaptations, a similar four bar mechanism or four bar linkage, would also be suitable for evacuating ejected cartridges from a weapon of the type that ejects them in a downwards direction.

Thus, in view of the description presented above while referring to the accompanying figures, any professional in the field of design and development of weapon stations in general and RCWS units in particular, would appreciate the fact that a means in accordance with the invention for routing spent cartridges, is a reliable and reasonably low priced solution to the challenge of routing and gathering the ejected cartridges from weapon stations. Implementing means for routing spent cartridges in accordance with the invention, enables to maintain the height of the weapon station (as it does not compel the elevation the of cradle assembly axis relative to the weapon station base assembly). Using means for routing spent cartridges in accordance with the invention does not restrict the elevation capability of the weapon. Installing such means does not overload the cradle's elevation and lowering axis (and see in the example described above—only the moveable assembly is connected to the cradle while supported by the moveable arm assembly). In maritime applications usage made of means for routing spent cartridges in accordance with the invention enable positioning the weapon station even on the edge of the vessel's deck. Means in accordance with the invention, is solely an inert mechanism, that does not require propelling nor control means and constitute an independent add-on means (stand alone), that is not relying on the weapon's manner of operation or on the firing executed from it and does not require any kind of timing input correlation with the weapon in order to provide an efficient spent cartridge removal system.

While the above description contains many specifications, the professional reader should not construe these as limitations on the scope of the spent cartridges router mechanism which is the subject matter of the invention, but merely examples of embodiments thereof. It will be apparent to those skilled in the art of designing and manufacturing such mechanisms that various modification and variations can be made in the router mechanisms of the present invention without departing from the spirit or scope of the invention. Thus, it is intended that the present invention cover modifications and variations that come under the scope of the following claims and their equivalents.

What is claimed is:

1. A weapon station, comprising:

a base assembly rotatable around a first axis;

a cradle assembly axially coupled to the base assembly at a second axis, wherein the cradle assembly is configured to house a chain-fed automatic weapon and elevate and lower the weapon around the second axis;

a cartridge gathering vessel configured to hold ejected cartridges that have been ejected from the weapon upon firing the weapon;

a routing assembly configured to route ejected cartridges from the weapon to the cartridge gathering vessel, the routing assembly comprising a moveable routing assembly and a moveable arm assembly;

a four-bar linkage mechanism having a crank, a rocker, and a connecting rod, wherein the moveable arm assembly comprises the rocker of the four-bar linkage mechanism.

2. The weapon station of claim 1, wherein:

the moveable routing assembly is axially linked to the cradle assembly at a third axis positioned a distance L from the second axis;

the distance L comprises the crank of the four-bar linkage mechanism; and the moveable routing assembly comprises the connecting rod of the four-bar linkage mechanism.

3. The weapon station of claim 2, wherein the routing assembly routes by gravitational force the ejected cartridges through the moveable routing assembly to a static routing assembly and into the cartridge gathering vessel.

4. The weapon station of claim 1, wherein the cartridge gathering vessel is located on a rear portion of the base assembly.

5. The weapon station of claim 1, further comprising:

a means for routing the empty links of the weapon's feeding chain ejected from the weapon towards a means for gathering links.

6. The weapon station of claim 5, wherein:

the links have a first end coupled in an axial manner to the cradle assembly and a second end coupled in an axial manner to the base assembly;

the means for gathering links comprises a surface for sliding the links; and the means for gathering links comprises a telescopic mechanism for adapting a length of the telescopic mechanism.

7. The weapon station of claim 6, wherein the means for gathering links is located on the base assembly.

8. The weapon station of claim 1, wherein the station is a Remote Control Weapon System (RCWS).

* * * * *